United States Patent [19]

Smith

[11] Patent Number: 4,856,923

[45] Date of Patent: Aug. 15, 1989

[54] RIBBON SHIELD

[75] Inventor: Phil N. Smith, Valencia, Calif.

[73] Assignee: Dataproducts Corporation, Woodland Hills, Calif.

[21] Appl. No.: 51,478

[22] Filed: May 18, 1987

[51] Int. Cl.[4] ..... B41J 13/10

[52] U.S. Cl. ..... 400/247; 400/248; 400/248.1

[58] Field of Search ..... 400/247, 248, 248.1

[56] References Cited

U.S. PATENT DOCUMENTS

| | | | |
|---|---|---|---|
| 4,165,188 | 8/1979 | Rempel | 400/248 X |
| 4,383,775 | 5/1983 | Trammell et al. | 400/248 X |
| 4,422,785 | 12/1983 | Shore | 400/247 X |
| 4,496,256 | 1/1985 | McMorrow et al. | 400/248 |

FOREIGN PATENT DOCUMENTS

| | | | |
|---|---|---|---|
| 0100183 | 7/1980 | Japan | 400/248 |
| 472065 | 9/1937 | United Kingdom | 400/247 |
| 2108049 | 5/1983 | United Kingdom | 400/248 |

*Primary Examiner*—Edgar S. Burr
*Assistant Examiner*—Kimberly L. Asher
*Attorney, Agent, or Firm*—Spensley, Horn, Jubas & Lubitz

[57] ABSTRACT

A thin metal ribbon shield for mounting in a standard data processing printer ribbon guide. The ribbon shield has a short insert tab and a long insert tab, and is particularly designed for ease of installation and removal. The thin metal ribbon shield is durable and permits printhead gap settings from the paper of the minimum distance capable in a printer. The ribbon shield is unlikely to kink during installation or removal because the stress when bending the shield is at the juncture of the long insert tab and the ribbon shield, rather than down the middle of the shield face.

3 Claims, 1 Drawing Sheet

RIBBON SHIELD

BACKGROUND OF THE INVENTION

1. Field of the Invention

This invention relates to data processing printers, and more particularly to a ribbon shield for a dot-matrix printer ribbon guide.

2. Description of Related Art

FIG. 1 discloses a perspective view of a dot-matrix type data processing printer printhead mechanism 10 that would be mounted in a printer such that it may traverse the width of a print medium such as paper (not shown). An inked ribbon 12 is threaded through a ribbon guide 13 such that the ribbon 12 is interposed between wire printer impact elements (not shown) of the printhead mechanism 10 and the paper.

FIG. 2 is a closeup perspective view of a typical prior art ribbon guide 13 (for example, the illustrated ribbon guide may be used in a Centronics 350 printer, manufactured by the Centronics Data Computer Corporation of Hudson, N.H.). Shown is an attachment fixture 20 for affixing the ribbon guide 13 to the printhead mechanism 10. A short guide wing 21 and a long guide wing 22 guide the ribbon 12 away from the paper from a ribbon supply area to a ribbon take-up area (not shown). A slot 23 running the width of the front face of the ribbon guide 13 permits insertion of the ribbon 12 into the guide.

The ribbon guide 13 maintains a section of the ribbon 12 juxtaposed against the paper. The ribbon 12 spans an opening 24 in the ribbon guide 13 from a first edge 25 to a second edge 26. The exposed section of the ribbon 12 (approximately $\frac{1}{2}'' \times \frac{1}{2}''$ in size), if unshielded, potentially would smear the paper with ink as the printhead mechanism 10 traverses the width of the paper. Therefore, in the existing art, a "ribbon shield" has been attached to the ribbon guide 13 to cover the majority of the ribbon section exposed by the ribbon guide 13, leaving only a small opening through which the printer impact elements may press the ribbon 12 against the paper to produce desired impressions.

Ribbon shields in the past have proven inadequate or disadvantageous in a number of ways. One such ribbon shield 30, shown in FIG. 2, is made of plastic typically having a thickness of approximately 0.0075 inches. It has a long wing 31 and a short wing 32 that are attached to the outer face of a ribbon guide 13 of the type shown in FIG. 2 by means of small hook-like projections (not shown) on the ribbon guide 13 that engage small holes 33, 34 in the plastic ribbon shield 30. A small printer impact element opening 35 is provided to permit the printer impact elements to press the ribbon 12 against the paper.

There are several disadvantages to this prior art plastic ribbon shield 30. It is difficult to assemble properly to the front face of the ribbon guide 13, and thus relatively expensive to manufacture. As its surface is dragged across the paper when the printhead mechanism 10 traverses the width of the paper, the plastic is subjected to wear and frequently breaks, falling off entirely or jamming in the printer mechanism. Another disadvantage of this type of ribbon shield is that it requires a relatively large gap between the printer impact elements and the paper, which limits print quality. In one printer in which such a plastic, front-surface mounted print shield 30 is used, the printhead mechanism must be placed in its No. 4 print position, rather than a position closer to the paper, in order to minimize jamming of the printer mechanism.

FIG. 3 shows another prior art ribbon shield 40 that has several advantages over the plastic ribbon shield 30 described above, yet does not completely eliminate certain problems. This ribbon shield 40 is manufactured typically of stainless steel having a thickness of 0.004 inches. The ribbon shield 40 has a shield face 43 and two short (typically 1/16" to 2/16") insert tabs 41, 42 on either side of the shield face 43. The ribbon shield 40 is attached to the foremost surface of a ribbon guide 13 of the type shown in FIG. 3 by inserting the tabs 41, 42 under the corresponding edges 25, 26 of the ribbon guide 13. This metal ribbon shield 40 allows for closer printhead mechanism 10 settings than the plastic version 30 (typically at the No. 2 position rather than the No. 4 position in the same printer), and does not generally wear out or fall off. However, because it is relatively thick and stiff, and must be bent somewhat in the middle of the shield face (along a line A dividing the print shield 40 about in half longitudinally), it is difficult to factory install without "kinking" (i.e., applying stress beyond its yield point) the shield. This is particularly a problem since the shield face is weakened by a printer impact element opening 44. An end-user would have a difficult time removing this ribbon shield 40 should it be desired to set the printer to its closest printhead setting, and it would be even more difficult for an end-user to reinstall this type of ribbon shield without permanently kinking the part.

Therefore, it is desirable to have a printer ribbon shield that is easily installed, easily removable, durable, unlikely to kink during installation or removal, and which permits printhead gap settings from the paper of the minimum distance capable in a printer.

SUMMARY OF THE INVENTION

These and other objectives are achieved by the present invention, which provides a thin (about 0.002 inches) metal ribbon shield for mounting in a standard ribbon guide of the type shown in FIG. 2. The thin metal shield has a short insert tab and a long insert tab, and is particularly designed for ease of installation and removal. The thin metal ribbon shield is durable and permits printhead gap settings from the paper of the minimum distance capable in a printer. Further, the novel ribbon shield is unlikely to kink during installation or removal because the stress when bending the shield is around the juncture of the long insert tab and the ribbon shield, and along the long insert tab, rather than down the middle of the shield face.

The advantages and structure of the present invention will be better understood in view of the detailed description below taken in conjunction with the accompanying drawings.

DESCRIPTION OF THE DRAWINGS

Like reference numbers in the various figures refer to like elements.

DETAILED DESCRIPTION OF THE INVENTION

Figure 4:
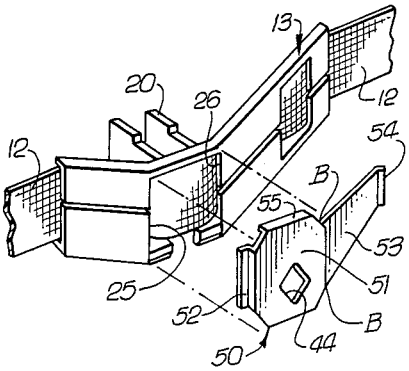
FIG. 4 shows a perspective view of a ribbon shield in accordance with the present invention, for use with a prior art ribbon guide.

FIG. 4 shows the innovative ribbon shield 50 in perspective view. It comprises a shield face 51 essentially identical to the shield face 43 of the prior art metallic ribbon shield 40 described above. The inventive ribbon shield in the preferred embodiment is formed of stainless steel and has a thickness of about 0.002 inches. A short (typically 1/16" to 2/16") insert tab 52 along one side of the shield face 51 is provided to be inserted under the corresponding edge 25 of the ribbon guide 13 to attach that side of the ribbon shield 50 onto the foremost surface of the ribbon guide. However, on the other side of the shield face 51, a long (typically 11/16") insert tab 53 is provided to be inserted under the edge 26 of the ribbon shield 13. The long insert tab 53 may typically have a length 3 to 20 times longer than the short insert tab 52.

In the preferred embodiment, the long insert tab 53 is tapered as shown. However, while such tapering provides additional ease of assembly, other shapes may be used for the long insert tab 53, including a simple straight parallel-edged insert tab.

In the preferred embodiment, the long insert tab 53 has a small turned-up "heel" 54 provided at its end which serves two functions. It provides a means to "catch" under the corresponding edge 26 of the face of the printer guide 13 under which the insert tab 53 is inserted, and also provides a smooth surface for ribbon 12 passage during use. Angled chamfers 55 at the top and bottom edges of the shield face 51 provide additional stiffness to the shield face, to reduce the possibility of kinking the shield face 51 upon insertion in or removal from a ribbon guide.

Figure 1:
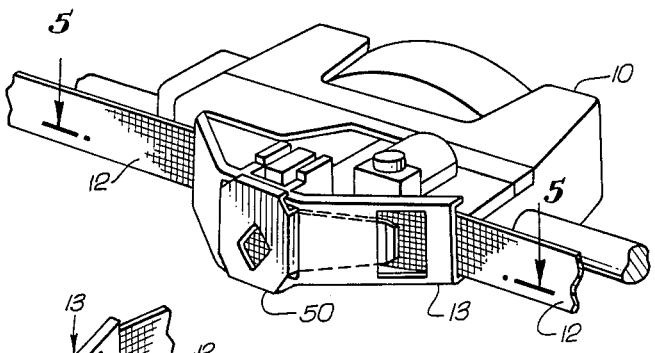
FIG. 1 is a perspective view of a dot-matrix type data processing printer printhead mechanism, on which is mounted a ribbon shield in accordance with the present invention.
Figure 2:
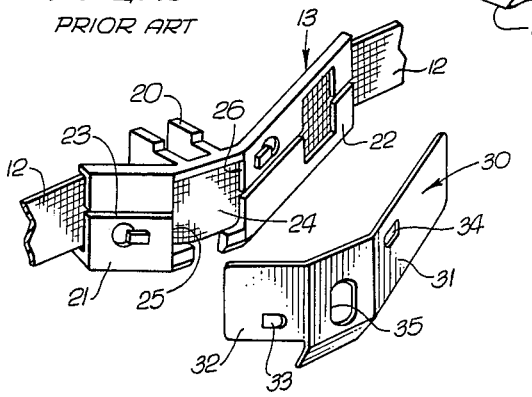
FIG. 2 PRIOR ART
FIG. 2 is a closeup perspective view of a typical prior art ribbon guide for use in the printhead mechanism of FIG. 1, further showing a first prior art ribbon shield.
Figure 5:
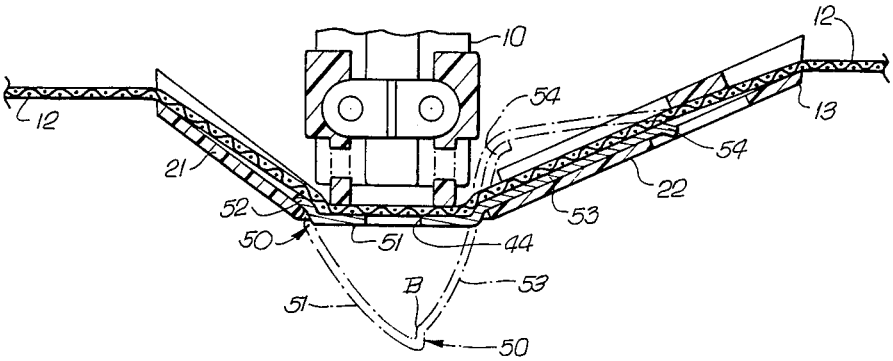
FIG. 5 shows a top cross-sectional view of the inventive ribbon shield and a prior art ribbon guide.

Because of both the thinness and greater length of the long insert tab 53 of the inventive ribbon shield 50, it is easier to bend for purposes of insertion and removal than are the short tabs 41, 42 of the prior art metal shields. For example, as shown in phantom outline in FIG. 5, in factory assembly, the short insert tab 52 may be first inserted under its corresponding edge 25 of the printer guide 13, and then the ribbon shield 50 is flexed around juncture B so that heel 54 of the long insert tab 53 can be placed under the second edge 26. The heel 54 of the long insert tab 53 "catches" under the edge 26. Light pressure on the shield face 51 will then "snap" the long insert tab 53 fully into position so that the ribbon shield 50 rests tightly against the foremost surface of the ribbon guide 13. FIG. 1 shows the inventive ribbon shield 50 fully inserted in a ribbon guide 13.

As an alternative, the "heel" 54 of the long insert tab 53 may be first inserted under the corresponding edge 26 of the ribbon guide 13 to "catch" that edge of the ribbon guide 13. Then the ribbon shield 50 is flexed around juncture B so that the short insert tab 52 can be placed under its corresponding edge 25 of the ribbon guide 13. Again, light pressure on the shield face 51 causes the ribbon shield 50 to "snap" into place.

The ribbon shield 50 may be removed by reversing the steps of either insert procedure.

Figure 3:
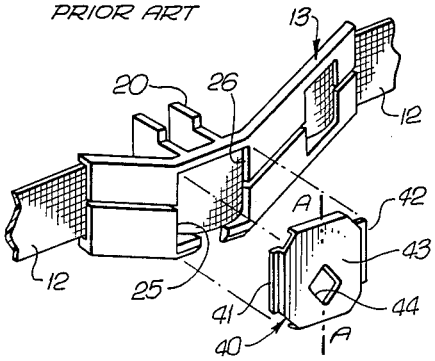
FIG. 3 PRIOR ART
FIG. 3 shows a perspective view of a second prior art ribbon shield for use with a prior art ribbon guide.

Because flexure of the inventive ribbon shield 50 is around juncture B, relatively little stress is placed on the thin shield face 51. It is thus less likely to kink in comparison to the prior art metal shield 40, which must be flexed around line A (as shown in FIG. 3) in order to insert both of its insert tabs 41, 42 under the ribbon guide 13 edges 25, 26.

The thinness of the ribbon shield 50 permits the printhead mechanism lo to be placed closer to the paper. In the printhead mechanism design discussed above, in which the prior art plastic shield required that the printhead mechanism 10 be pulled back to its No. 4 position, and the prior art metal shield required that the printhead mechanism 10 be pulled back to its No. 2 position, use of the present invention permits the same printhead mechanism to be situated at its No. 1 print position, closest to the paper. This provides for greater printer efficiency and better print quality.

The long insert tab 53 design thus allows much easier factory assembly, as well as the ability for an end-user to remove and replace the ribbon shield 50 without damaging it (even though such removal and replacement would be less likely, since the design of the present invention reduces the need to remove the ribbon shield 50 in order to obtain the closest possible printhead mechanism setting).

Although the present invention has been described with reference to a particular embodiment, the invention can be realized in various alternative manner. For example, as noted above, the long insert tab 53 need not be tapered as shown. Furthermore, although the preferred embodiment has a "heel" 54 at the end of the long insert tab 53, such a heel is not necessary for proper operation (although it does ease insertion and removal of the ribbon shield 50 and provide smooth ribbon passage). Moreover, although stainless steel is used for the material of the ribbon shield 50, other metals or materials may be used as desired. Further, while it is advantageous to manufacture the ribbon shield 50 using metal of about 0.002 inches thickness, other thicknesses may be used. Therefore, the scope of the invention is not limited to the present disclosure, but by the scope of the following claims.

I claim:

1. An easily removable thin metal ribbon shield for use with a ribbon guide of a data processing printer having print impact elements for imprinting a print medium, the ribbon guide having an open portion for exposing a section of ribbon, the ribbon shield comprising:

(a) a shield face, for preventing general contact of the ribbon with the print medium through the open portion of the ribbon guide, and having an opening for permitting the ribbon to be impressed through the ribbon shield onto a print medium by print impact elements;

(b) a short insert tab means disposed on one side of the shield face, and formed in a shape and of sufficient length for secure engagement under an edge of the open portion of the ribbon guide and such that the shield face can be flush mounted over the exterior of the open portion of the ribbon guide; and (c) a long insert tab means disposed on an opposing side of the shield face, the long insert tab means (1)having a first part attached to the shield face and formed in a shape and of a sufficient length such that the shield face can be flush mounted over the open portion of the ribbon guide, and (2) having a second, elongated part attached at an angle to the first part and being flexible around its juncture with the first part, for insertion under the opposing edge of the open portion of the ribbon guide, the long insert tab means being at least 3 times longer than the short insert tab means and bent at its far end to form a heel to aid in insertion of the long insert tab means under its corresponding edge of the open portion of the ribbon guide;

wherein the ribbon shield is flush mounted on the foremost surface of the ribbon guide upon complete engagement of the short insert tab means and the long insert tab means under their respective edges of the ribbon guide, and is removable by disengaging the insert tabs means from beneath their respective edges of the ribbon guide, and wherein essentially no flexure occurs across the shield face when the ribbon shield is inserted or removed from a ribbon guide.

2. The ribbon shield of claim 1, wherein the metal of the ribbon shield is approximately 0.002 inches thick.

3. The ribbon shield of claim 1, wherein the long insert tab means is tapered to its far end from approximately its juncture with the shield face.

* * * * *